US006164480A

United States Patent [19]

Heinicke et al.

[11] Patent Number: 6,164,480

[45] Date of Patent: Dec. 26, 2000

[54] CAN LID WITH STAY-ON-TAB

[75] Inventors: Paul R. Heinicke, Canton; Trevor Price, Arron, both of Ohio

[73] Assignee: Crown Cork & Seal Technologies Corporation, Alsip, Ill.

[21] Appl. No.: 09/281,614

[22] Filed: Mar. 30, 1999

[51] Int. Cl.[7] ..... B65D 17/34

[52] U.S. Cl. ..... 220/269

[58] Field of Search ..... 220/269, 370, 220/906

[56] References Cited

U.S. PATENT DOCUMENTS

| | | | |
|---|---|---|---|
| 3,957,172 | 5/1976 | Hasegawa | 220/269 |
| 3,967,752 | 7/1976 | Cudzik | 220/269 |
| 4,024,981 | 5/1977 | Brown | 220/269 |
| 4,148,410 | 4/1979 | Brown | 220/269 |
| 4,150,765 | 4/1979 | Mazurek | 220/269 |
| 4,276,993 | 7/1981 | Hasegawa | 220/269 |
| 4,286,728 | 9/1981 | Fraze et al. | 220/270 |
| 4,318,493 | 3/1982 | Jacobsen et al. | 220/270 |
| 4,465,204 | 8/1984 | Kaminski et al. | 220/269 |
| 4,524,879 | 6/1985 | Fundom et al. | 220/273 |
| 4,681,238 | 7/1987 | Sanchez | 220/260 |
| 4,821,912 | 4/1989 | Wells | 220/231 |
| 4,930,658 | 6/1990 | McEldowney | 220/269 |
| 5,007,554 | 4/1991 | Hannon et al. | 220/269 |
| 5,064,087 | 11/1991 | Koch | 220/269 |
| 5,129,541 | 7/1992 | Voigt et al. | 220/269 |
| 5,385,254 | 1/1995 | Hannon | 220/269 |
| 5,653,355 | 8/1997 | Tominaga et al. | 220/269 |
| 5,692,636 | 12/1997 | Schubert | 220/269 |
| 5,711,448 | 1/1998 | Clarke, III | 220/269 |
| 5,715,964 | 2/1998 | Turner et al. | 220/269 |
| 5,931,331 | 8/1999 | Kirk et al. | 220/269 |

FOREIGN PATENT DOCUMENTS

| | | |
|---|---|---|
| 48122/85 | 4/1986 | Austria . |
| 0 432 659 A1 | 6/1991 | European Pat. Off. . |

*Primary Examiner*—Nathan J. Newhouse
*Attorney, Agent, or Firm*—Woodcock Washburn Kurtz Mackiewicz & Norris LLP

[57] ABSTRACT

A can lid having a top plate, a tab, a rivet, a score, a tongue, a first deboss, an emboss, a second deboss, and an embossed ridge. The first deboss is formed entirely within the score. The second deboss and emboss are formed entirely within the first deboss. The second deboss is formed by matching arcuate sidewalls, and has a sloped bottom surface. The rivet is offset from a center of the lid. The tongue is disposed between the rivet and top plate perimeter where the rivet is closest to the perimeter. The emboss is uniformly spaced from the score. An embossed ridge is uniformly spaced from the score outside of the score. In another embodiment, the second deboss is replaced with a contact emboss. A die insert for forming the first deboss, emboss, and second deboss (and, alternatively, contact emboss) is also disclosed.

20 Claims, 12 Drawing Sheets

CAN LID WITH STAY-ON-TAB

FIELD OF THE INVENTION

The present invention relates to containers, and more particularly to metal containers having a pull type opening tab.

BACKGROUND OF THE INVENTION

Easy opening beverage containers are well known in the beverage industry. Typically, a beverage container comprises a body and a separate can end or lid formed of an aluminum sheet—typically 0.011" (0.28 mm) to 0.013" (0.33 mm) thick. A conventional can lid may employ one of several pull-type tabs. A popular type of lid has a tab that is attached to a top plate by a rivet to form a lever. To open the can, a user lifts one end of the tab to urge the other end downward against a tongue or tear panel formed by a score in the top plate. The tab member forces the tongue downward until the score pattern ruptures. The score may be discontinuous to form a hinge area that connects the tongue to the top plate, even after opening.

A common operation for forming a can end having a tongue defined by a score pattern comprises the step of placing a metal material between a score die and mating anvil. Thereafter, the score die is brought down upon the metal material with a force sufficient to depress the metal material to form the score pattern.

Ease of opening and enhanced strength of the lid components are long standing goals of designers and researchers. For example, U.S. Pat. No. 5,653,355 to Tominaga et al. ("Tominaga") discloses a can lid having a top plate, a tab, a tongue formed by a score, and a hinge area formed in the lid. However, the lid disclosed in the Tominaga patent has several drawbacks. First, the top plate has a center which is a fulcrum point. Such a layout may not be desired in light of tongue size and location, tab length, aesthetics, strength characteristics, and like variables.

Second, the Tominaga patent discloses that the force application point, the fulcrum point, the tab nose, and the depression force point form a straight line. Such an alignment restricts the depression force point to a location that is not optimum with respect to the opening characteristics. Third, the Tominaga patent discloses a recess that is disposed beneath the tab nose having a straight side perpendicular to the straight line as defined above. The straight side yields to an arcuate side generally to form a D-shaped recess. This D-shape inherently requires a large surface area in the critical tongue area, within which space should be conserved, and might position a stress riser at a problematic location. Fourth, a large deboss in the top plate of the Tominaga patent contains and is disposed outside of the score area and tab, which has inherent drawbacks, especially with respect to the score. Furthermore, like many can lid designs, the lid disclosed in the Tominaga patent may be prone to loose metal or excess metal in the tongue area, and may generally not provide optimum accessibility to the finger of the user (that is, mechanical and geometrical characteristics of the tab with respect to the tongue and the top plate).

The present invention is directed to the goals of improving the opening considerations of pull type tabs, as well as possessing other attributes that will be apparent to persons familiar with such technology.

SUMMARY

Accordingly, a can lid is provided that accomplishes the goals. The can lid that has a top plate and a tab that is coupled to the top plate by a rivet. The tab has a nose and an opposing heel. A score, which is formed in the top plate, has a first end and a second end that define a hinge portion therebetween. The score defines a tongue, formed in the top plate, that is coupled to the hinge portion. A first deboss is formed entirely in the tongue within the score. An emboss also is formed in the tongue. An arcuate second deboss is formed in the tongue between the rivet and the emboss. The emboss and the second deboss may be formed within the first deboss.

The first deboss has a first arcuate side and an opposing second arcuate side. The second deboss is capable of receiving a depression force applied by the tab nose. The second deboss may have a bottom surface of varying depth. Specifically, the second deboss may have a sloped bottom surface that has a shallow end and opposing deep end so as to form an incline within the second deboss. Thus, second deboss forms a can.

According to a second embodiment of the present invention. a can lid is provided that has an arcuate contact emboss disposed below the tab nose. According to a third embodiment of the present invention, a can lid is provided that has a contact emboss having opposing straight sides. The can lid according to the second and third embodiments lack a second deboss, but includes a top plate, a tab, a rivet, a tongue, a score, a hinge area, a first deboss, and a primary emboss, as generally described above. The contact emboss may be disposed within the first deboss, which maybe disposed entirely in the tongue. Further, the contact emboss may have a short end and a tall end so that the contact surface on the tab nose contacts the tall end before contacting the short end.

According to another aspect of the present invention, a die insert for forming the first deboss, second deboss, and emboss is provided. The die insert according to the present invention includes these features generally according to the description thereof as above.

The present invention has several inventive and beneficial aspects, including: the emboss and the second deboss may be formed entirely in the tongue; the first deboss is formed entirely within the score; the can lid may comprise an embossed ridge, disposed on the top plate outside of the tongue, such that most of the emboss ridge is spaced equidistant from the score; the second deboss may be formed by two opposing arcuate sides equidistantly spaced apart; and the fulcrum point is not disposed at the center of the lid.

Further, the sloped surface of the second deboss enables the tab nose to contact the shallow end of the second deboss prior to contacting the deep end. Thus, the contact point or depression force point is offset from a centerline defined by a centerlines of the tab heel, rivet, and tab nose, thereby providing control of the location, direction, and distribution of forces applied to the tongue by the tab. The sloped surface of the contact emboss provides similar advantages.

Providing the first deboss that is entirely within the tongue eliminates problems associated with loose metal that may be exacerbated in embodiments in which the score area is debossed. The heart shaped second deboss and embossed ridge generally follow the score, and thus provide stress and scratch barriers for the score.

DETAILED DESCRIPTION OF PREFERRED EMBODIMENTS

Figure 1:
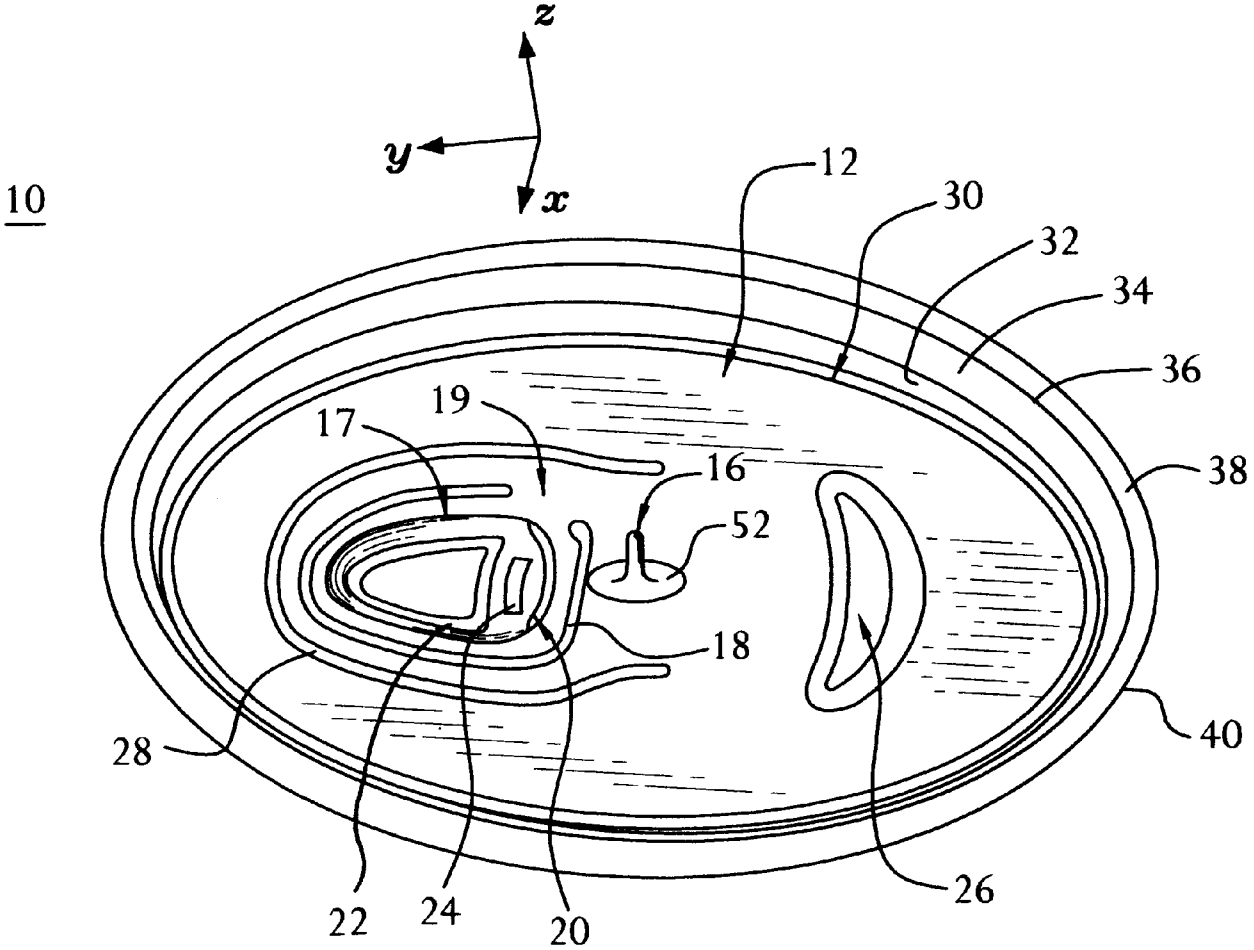
FIG. 1 is a perspective view of a first embodiment of a can lid according to the present invention, with the tab removed for clarity and the rivet shown in an undeformed state.
Figure 2:
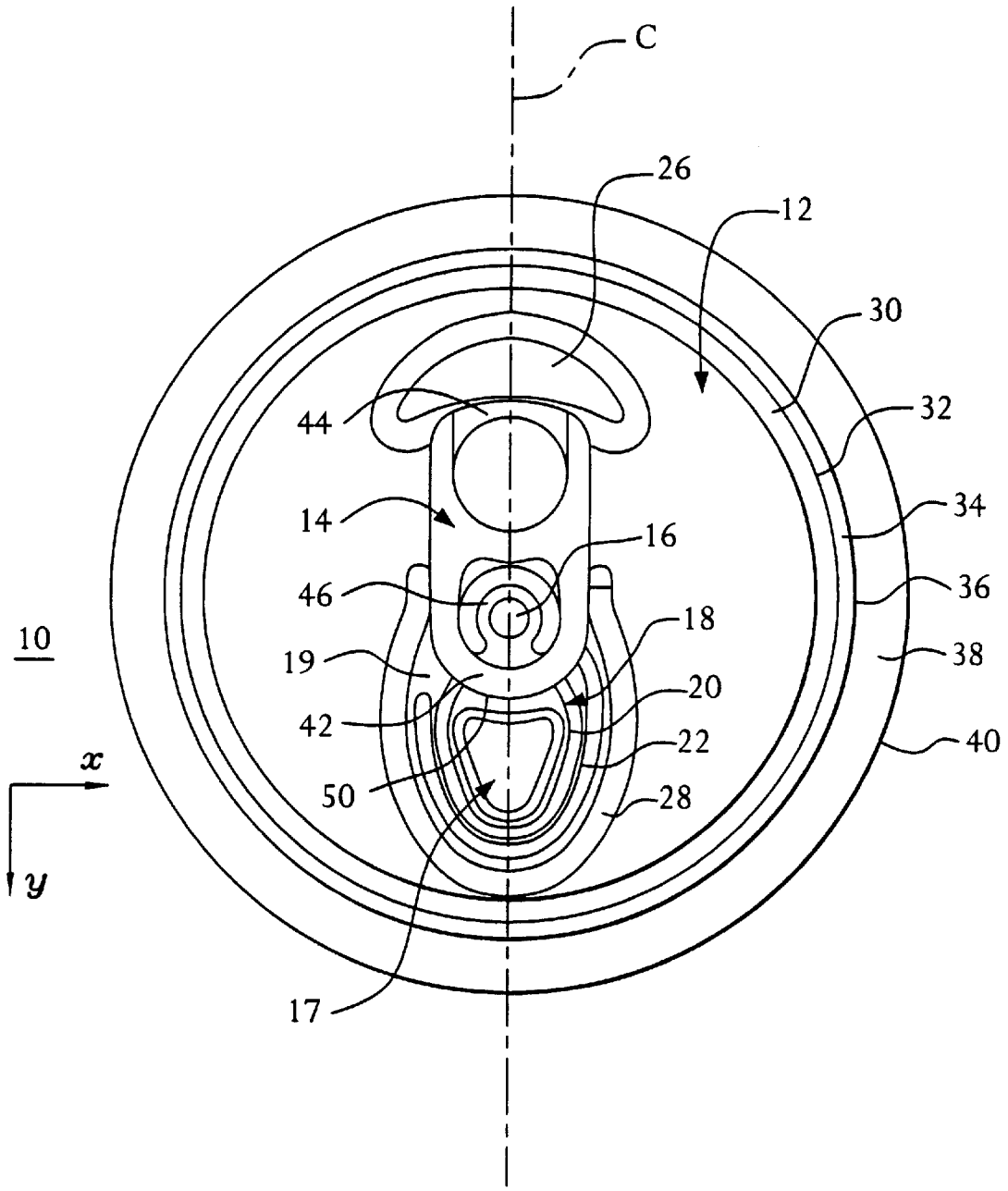
FIG. 2 is a top view of the embodiment shown in FIG. 1, but showing the tab.
Figure 3:
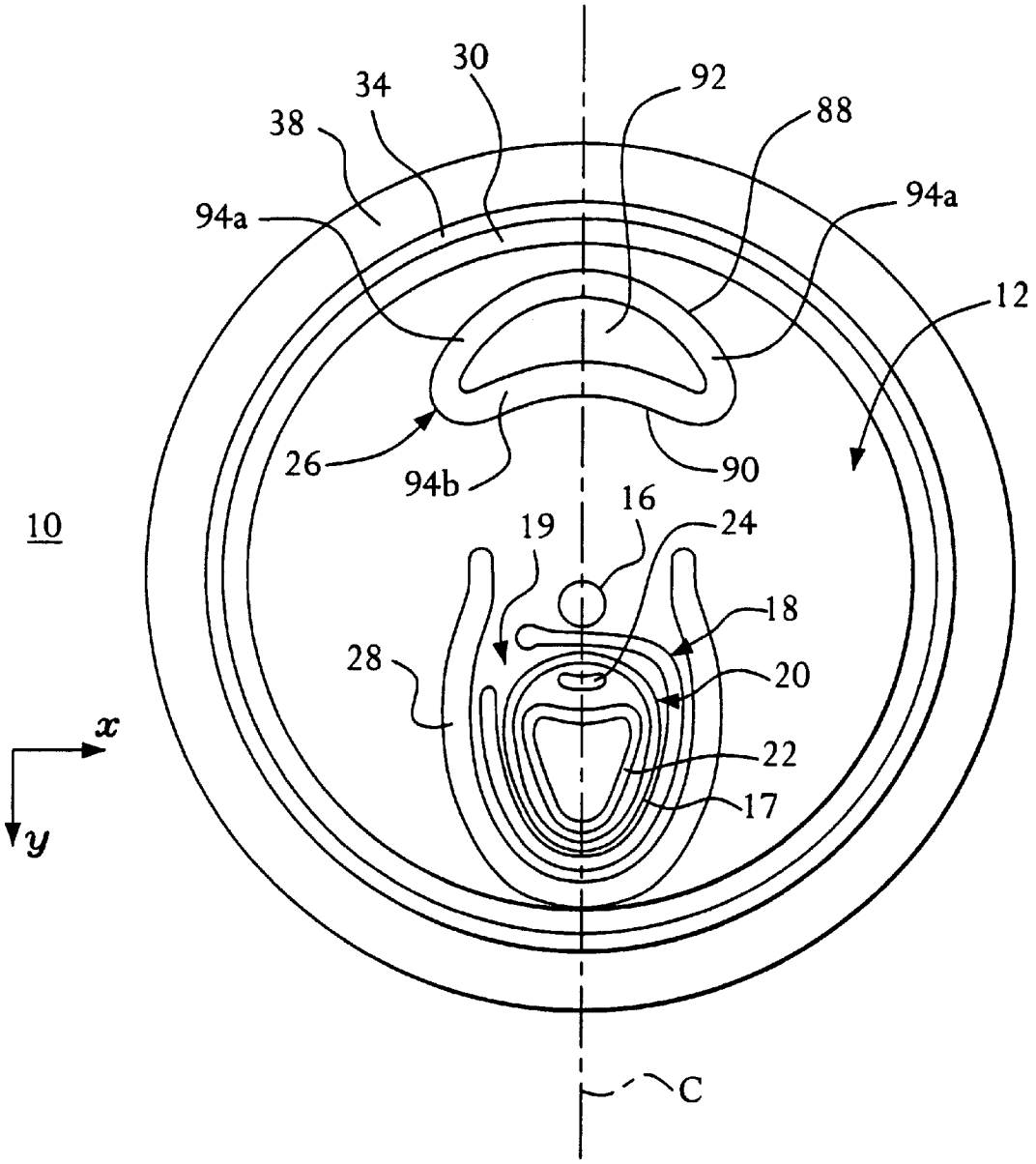
FIG. 3 is a top view of a portion of the embodiment show in FIG. 1.

Referring to FIGS. 1 through 8 to illustrate a first embodiment of the present invention, and especially FIGS. 1, 2, and 3, a can lid 10 is provided that includes a top plate 12, a tab 14, a rivet 16, a tongue 17, a score 18, a hinge area 19, a first deboss 20, a primary emboss 22, a second deboss 24 (best seen in FIG. 3), a back-side deboss 26, and an embossed ridge 28. Further, the lid 10 includes, at its outer periphery, an outer groove 30, a lower sidewall 32, a shoulder 34, an upper sidewall 36, a ring 38, and a lip 40. Lid 10 is of the type that may be placed onto a cylindrical can body to form a beverage container. For example, can lid 10 may be used in a twelve ounce beverage container.

Figure 5:
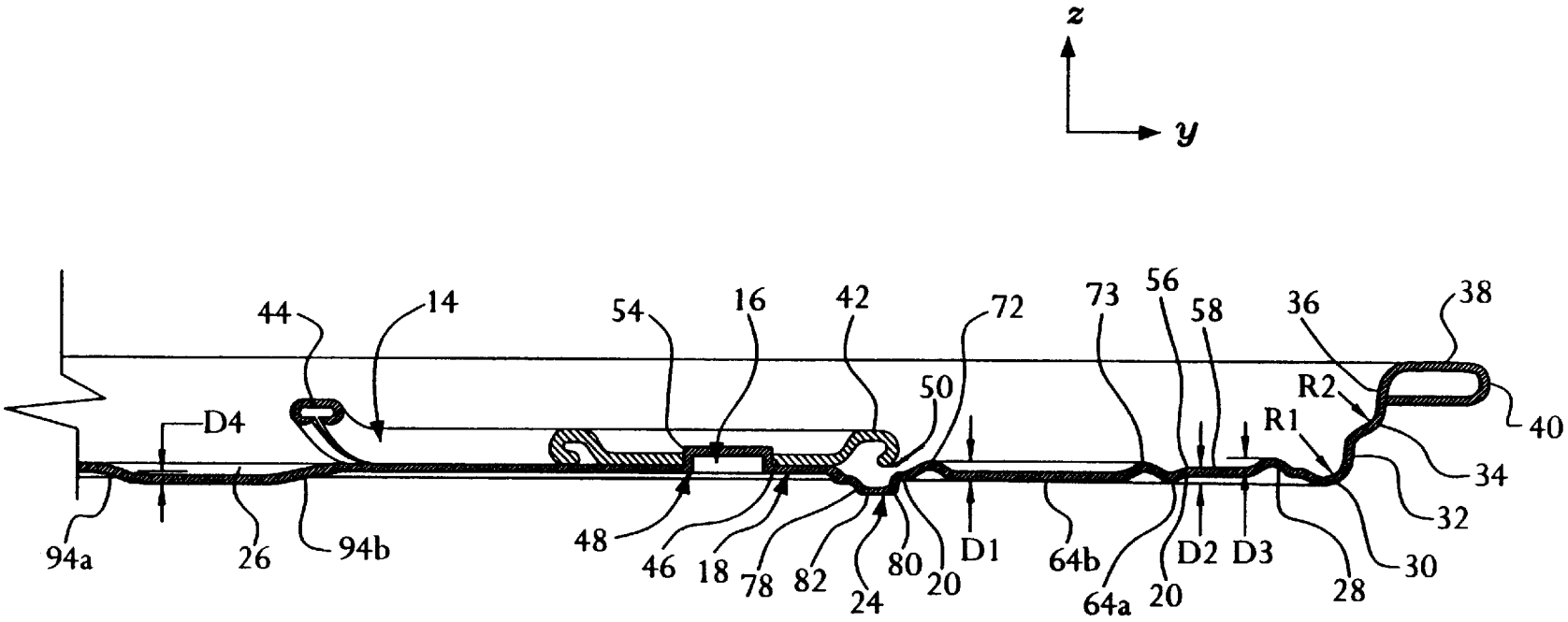
FIG. 5 is a partial cross-sectional view of the embodiment of FIG. 1 showing the forward portion of the can lid.
Figure 8:
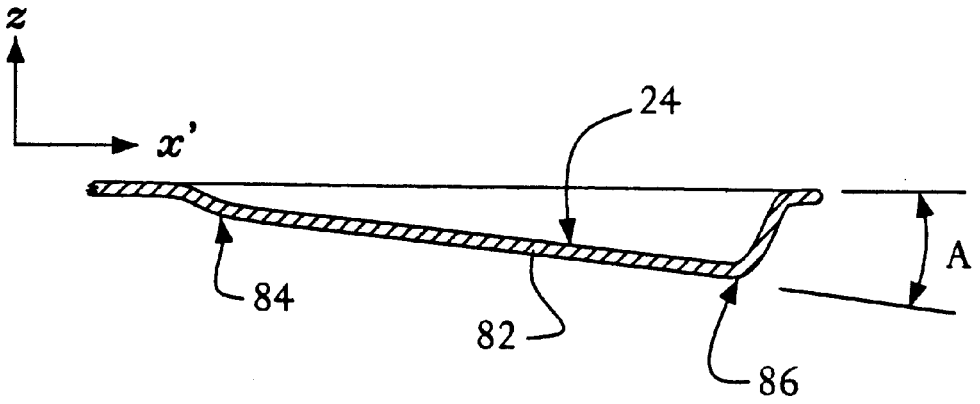
FIG. 8 is a cross-sectional view taken through FIG. 7 along lines 8—8.

For illustrating the present invention, the convention of the axes shown in the Figures will be employed such that the positive x axis extends right as shown in FIGS. 2 and 3, and the positive y axis extends down as shown in FIGS. 2 and 3. Further, the positive z axis is as shown in FIGS. 1, 5, and 8. The axes x, y, and z are mutually perpendicular in each of the Figures. Further, some figures define an x' and a y' axis, which are mutually perpendicular and perpendicular to the z axis. As used in the specification and appended claims, the term "forward" refers to a direction or disposition relatively in the positive y direction (that is, directed to the lower portion of FIGS. 2 and 3), and the terms "back" and "rear" refer to a direction or disposition relatively in the negative y direction (that is, directed to the upper portion of FIGS. 2 and 3). The term "deboss" refers to a recession and the term "emboss" refers to a raised area.

Top plate 12 is substantially circular, and is substantially flat except for embosses, debosses, and peripheral portions as described herein. An inner portion of top plate 12 is circular, and is continuously surrounded by outer groove 30. Groove 30 is a circular or annular recess preferably having a semicircular cross sectional shape defining a radius R1 that preferably is approximately 0.038" (0.97 mm). Lower sidewall 32 rises from the periphery of outer groove 30 substantially to form a short cylinder or frustum of a right circular cone. Lower sidewall 32 smoothly yields to a slightly inclined portion at its outer periphery to form shoulder 34 which smoothly yields to upper sidewall 36 and to define a radius R2 that is approximately 0.035" (0.89 mm). Upper sidewall 36 substantially is a short cylinder or frustum of a right circular cone that yields to a substantially horizontal ring 38, which is preferably wide compared to the width and height of groove 30, lower sidewall 32, shoulder 34, and upper sidewall 36. An upper side of ring 38 yields to a circular nose that forms lip 40. Preferably, top plate 12, outer groove 30, lower sidewall 32, shoulder 34, upper sidewall 36, ring 38, and lip 40 are formed from substantially flat metal having a circular shape.

Figure 6:
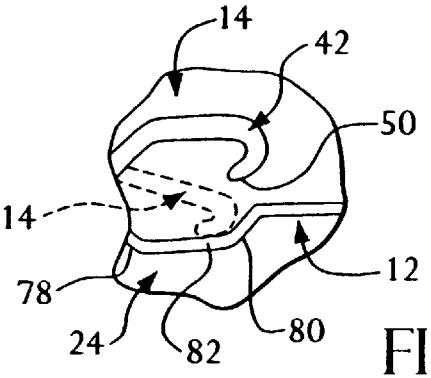
FIG. 6 is an enlarged portion of FIG. 5 that shows the tab nose and second deboss areas.

Referring particularly to FIGS. 2, 5, and 6, tab 14 includes a tab nose 42, a tab heel 44, a flange 46, a hole 48, and a contact surface 50. Tab 14 is preferably formed of thin gauge metal that forms two integral, side-by-side circular shapes to resemble a figure eight. As best shown in FIG. 2, tab nose 42 forms a forward end of tab 14 and preferably is arcuate. Tab heel 44 is formed on the back end of tab 14 opposite tab nose 42, and preferably is arcuate. Tab heel 44 is less rounded than tab nose 42 to enhance gripping by a finger of a user. The term "arcuate," as used in the present application, broadly refers to a rounded or curved shape that may be circular, but encompasses other rounded shapes such as (for example) elliptical, ovate, and irregularly rounded shapes. Further, the term "arcuate" excludes straight or rectilinear line shapes.

Tab 14 preferably is formed by bent metal such that tab nose 42 has a rounded profile both in plan view (as best shown in FIG. 2) and in elevation view (as best shown in FIGS. 5 and 6). Specifically, tab nose 42 is formed on a raised portion of tab 14 (that is, in the positive z direction with respect to flange 46) and bent over to form a smooth tip. Contact surface 50 is disposed on tab nose 42 near the distal tip of tab 14 on the underside of a bent-over portion of the tab nose 42.

Referring particularly to FIG. 2, a tab centerline C is defined by the center of tab heel 44, the center of rivet 16, and the center of tab nose 42. Centerline C is parallel to the y direction. As explained more fully below, and according to an aspect of the present invention, the center of contact surface 50 preferably is not coincident with centerline C. Specifically, contact surface 50 defines a force application point at the point of contact between contact surface 50 and a portion of top plate 12 (that will be defined more fully below).

Flange 46 is substantially flat and projects inward from a circular portion of the tab 14 opposite tab nose 42. As best shown in FIG. 5, flange 46 is disposed near a lower portion (that is, in the z direction) of tab 14. Hole 48 is formed in flange 46 to receive rivet 16, as described below. Flange 46 has an upward-facing top side, and an underside that forms a bearing surface that is disposed on a flat portion of top plate 12.

Referring particularly to FIGS. 1, 2, 3, and 5, top plate 12 forms a circle within groove 30. Rivet 16 is disposed on top plate 12 at a location that is forward (that is, in the positive y direction as shown in FIG. 1) from the center of top plate 12. Further, tongue 17 is forward of the rivet 16 (that is, disposed further in the positive y direction). Preferably, the center of rivet 16 is approximately 1.17" (2.97 cm) from the inside surface of lower sidewall 32 (measured where lower sidewall meets groove 30 along the C centerline) for a lid having a diameter of 2.45" (6.22 cm) diameter (measured from the inside surfaces of lower sidewall 32). Preferably, tongue 17 lies substantially between rivet 16 and lower sidewall 32 along the y direction, and even more preferably, tongue 17 is substantially symmetric about centerline C. Such a configuration reduces the distance from the rivet to the periphery of top plate 12, which enables a shorter (that is, in the y direction) tongue. This configuration has mechanical and ergonomic benefits in opening and pour characteristics because, for example, tongue 17 may be disposed near the lip of the lid (that is, near lower sidewall 32) while the distance between tab heel 44 and sidewall 32 is increased to provided more space for a user to apply a force to tab heel 44. U.S. Pat. No. 5,931,331, which is incorporated herein by reference in its entirety, provides a discussion of the configuration and its advantages.

Figure 4:
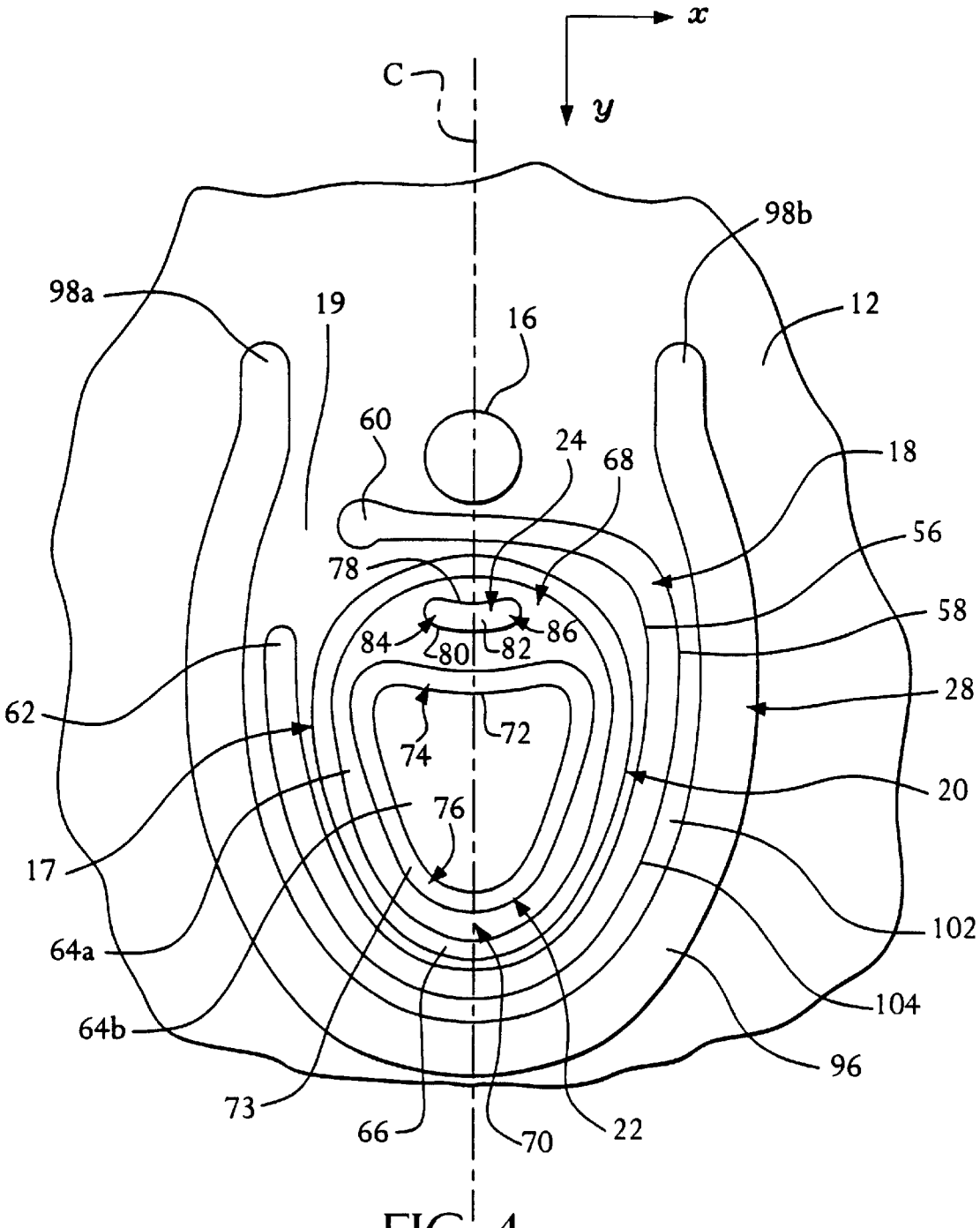
FIG. 4 is an enlarged top view of the forward portion of FIG. 3.

Referring particularly to FIGS. 1 through 5, rivet 16 protrudes upward from top plate 12, and preferably is integrally formed therefrom. Before assembly to tab 14, as best shown in FIGS. 1 and 4, rivet 16 preferably forms a rounded or hemispherical knob projecting above a rivet base 52. Rivet 16 projects through hole 48 in tab 14 and, after assembly, is deformed to clamp flange 46 to top plate 12. Specifically, rivet 16 is deformed against the top surface of flange 46 to form a contact surface 54 (as best shown in FIG. 5) that forces the downward-facing bearing surface of flange 46 against top plate 12, thereby clamping tab 14 to top plate 12. Flange 46 is clamped to top plate 12 around hole 48, and is, thus, fixed thereto.

A forward portion of flange 46 that is near but spaced apart from contact surface 54 is capable of bending in response to actuation of tab 14 by a user. The bendable line on the forward portion is one definition of a fulcrum point within the can lid industry. Other definitions may include, for example, the rivet centerline or the depression force application point. Regardless of the definition employed, the fulcrum point of the present invention is offset from the center of the top plate, and preferably is forward of the center, and the precise location of the fulcrum may be chosen according to the particular geometry of the lid components. Disposing the fulcrum forward of the center enables a relatively shorter distance from the fulcrum to tab nose 42 and a relatively longer distance from the fulcrum to the tab heel 44, which provides enhanced leverage capabilities. Further, because the distance between the tab heel and the perimeter of the can (for example, from sidewall 32) compared with fulcrum at the center of top plate 12, a user's finger may more easily access tab heel 44.

Referring particularly to FIGS. 1 through 5 to illustrate another aspect of the present invention, and as best shown in FIG. 4, a score 18 is disposed on top plate 12 forward of rivet 16, according to an aspect of the present invention. Score 18 includes an inner score line 56 and an outer score line 58. Score lines 56 and 58 are preferably uniformly spaced apart throughout their respective lengths except at their ends. Outer score line 58 forms the main score line that is capable of rupturing in response to actuation of tab 14 such that tongue 17 separates from the remainder of top plate 12 to form an opening therein (not shown). Inner score line 56 is an anti-fracture score line that prevents rupture of the main score line during forming.

The score residual (that is, the thickness of the metal at the bottom of the score line) of outer score line 58 is approximately 0.004" (0.10 mm), although this dimension may be varied along the length of the score. The score residual of inner score line 56 is preferably approximately 0.002" (0.05 mm) larger than the score residual of outer score line 58. Score 18 preferably is 0.015" (0.38 mm) above a lid base line, which is defined by the underside of outer groove 30, as measured from the base line to the upper side of top plate 12 between score lines 56 and 58. This distance is identified by reference numeral D2 in FIG. 5.

At a first end, score lines 56 and 58 meet at a head 60, as best shown in FIG. 4. At a second end, score lines 56 and 58 meet at a tail 62. Head 60 is preferably a bulbous transition between score lines 56 and 58. Head 60 is preferably disposed forward of rivet 16 on a first side thereof. Tail 62 is preferably a smooth, roughly semicircular transition between score lines 56 and 58.

Head 60 is generally disposed on the left, or in a negative x direction and to the front of rivet 16. From head 60, score 18 slants generally obliquely in front of rivet 16 such that score 18 has a relatively large positive x component and a relatively small (but preferably nonzero) positive y component. Score 18 makes a smoothly curved transition toward the positive y direction on the right side of rivet 16. Below, the curved transition, score 18 forms a roughly parabolic shape or horseshoe shape having its apex at the forward most point of score 18. The left leg of the parabola or horseshoe continues in the negative y direction until it ends at tail 62. Although score design 18 is preferred, the present invention encompasses employing scores or other configurations, although it is desirable for the score to follow the shape of the emboss.

Score 18 defines tongue 17 therein. Specifically, tongue 17 is defined by inner score line 56 to form a roughly parabolic or horseshoe shape. The portion of top plate 12 between head 60 and tail 62 defines hinge area 19, which is capable of bending to enable tongue 17 to form an opening upon actuation of tab 16 by the user. The rounded nature of head 60 and tail 62 prevents the rupture during opening from continuing into the hinge area 19.

According to another aspect of the present invention, first deboss 20 is formed in top plate 12 preferably entirely within score 18, as shown in best in FIG. 4. First deboss 20 has a wide end 68 on its back end and a narrow end 70 on its forward end to form an ovate shape. First deboss 20 includes lower portions (that is, referring to the z direction) **64*a* and 64*b*. At the perimeter of first deboss 20, top plate 12 yields to an inclined surface 66, which levels out and yields to lower portion 64*a*. Inclined surface 66 is indicated in the Figures by two, uniformly spaced apart lines to indicate the top edge and bottom edge of incline 66. However, inclined surface may be formed by a gradual transition from top plate 12 to lower portion 64*a*, in which case the location of the lines defining inclined surface 66** may change from as shown in the Figures.

Lower portion **64*a* is short (that is, in the plane defined by the x and y axes) in the lower narrow end 70, as lower portion 64*a* yields to emboss 22. Narrow end 70 substantially follows, and is uniformly spaced from, the parabolic or horseshoe portion of inner score line 56**.

Providing deboss 20 entirely within score 18 protects the score from scratching (that is, inclined surface 66 may catch any objects that may be sliding toward score 18 from tongue 17). Further, first deboss 20 enhances the strength or stiffness of score 18 as manifested in improved drop test or water pressure tests results. Also, because deboss 20 is lower (in the Z direction) than top plate 12, tab heel 44 may be pulled upward by a user by a predetermined distance before tab nose 42 encounters deboss 24, thereby easing opening.

According to another aspect of the present invention, emboss 22 is a substantially heart shaped emboss disposed entirely within first deboss 20. Emboss 22 has an arcuate portion 72 disposed at its back end that smoothly yields to a parabolic or horseshoe portion 73. Arcuate portion 72 forms an emboss wide end 74 at a back end of emboss 22 and a parabolic or horseshoe portion 73 that forms a narrow end 76 at a forward end of emboss 22. Portion 73 of emboss 22 preferably substantially follows, and is uniformly spaced from, the parabolic or horse shoe portion of first deboss 20, although the present invention is not limited to this spacing. Lower portion 64*b* of first deboss 20 lies within emboss 22. An underside of lower portion 64*b* is substantially at the same level as the base line defined by the underside surface of groove 30. The peak of the upper side of emboss 22 defines a dimension D1 (from the peak to the top surface of lower portion 64*b*) that is preferably approximately 0.020" (0.51 mm).

According to another aspect of the present invention, second deboss 24 is formed entirely within first deboss 20 forward of the rear portion of score line 18 and in back of emboss 22. Preferably, second deboss 24 is formed such that its perimeter is symmetric with a line in the y direction through the centerline C. Except for its perimeter, deboss 24 is asymmetric around such a y axis center line. The perimeter of second deboss 24 is formed by first arcuate side 78 and a matching second arcuate side 80 that is uniformly spaced apart from first arcuate side 78. Arcuate side 78 and 80 meet at opposing ends. Although the present invention describes sides 78 and 80 as matching, the present invention is not limited thereto. For example, the present invention encompasses arcuate sides having radii that are not the matching and/or that are not uniformly spaced apart.

Figure 7:
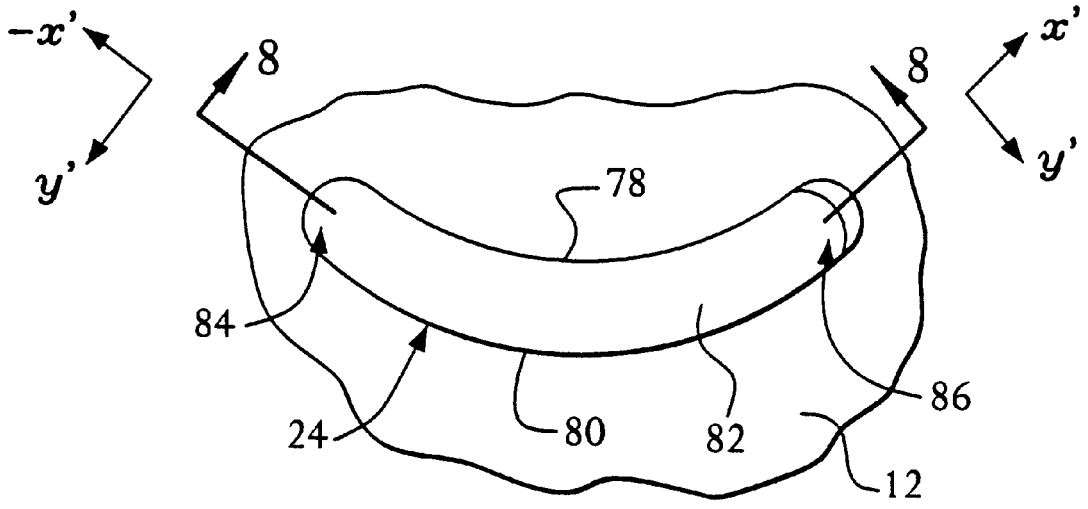
FIG. 7 is an enlarged portion of FIG. 3 that shows the second deboss.
Figure 9:
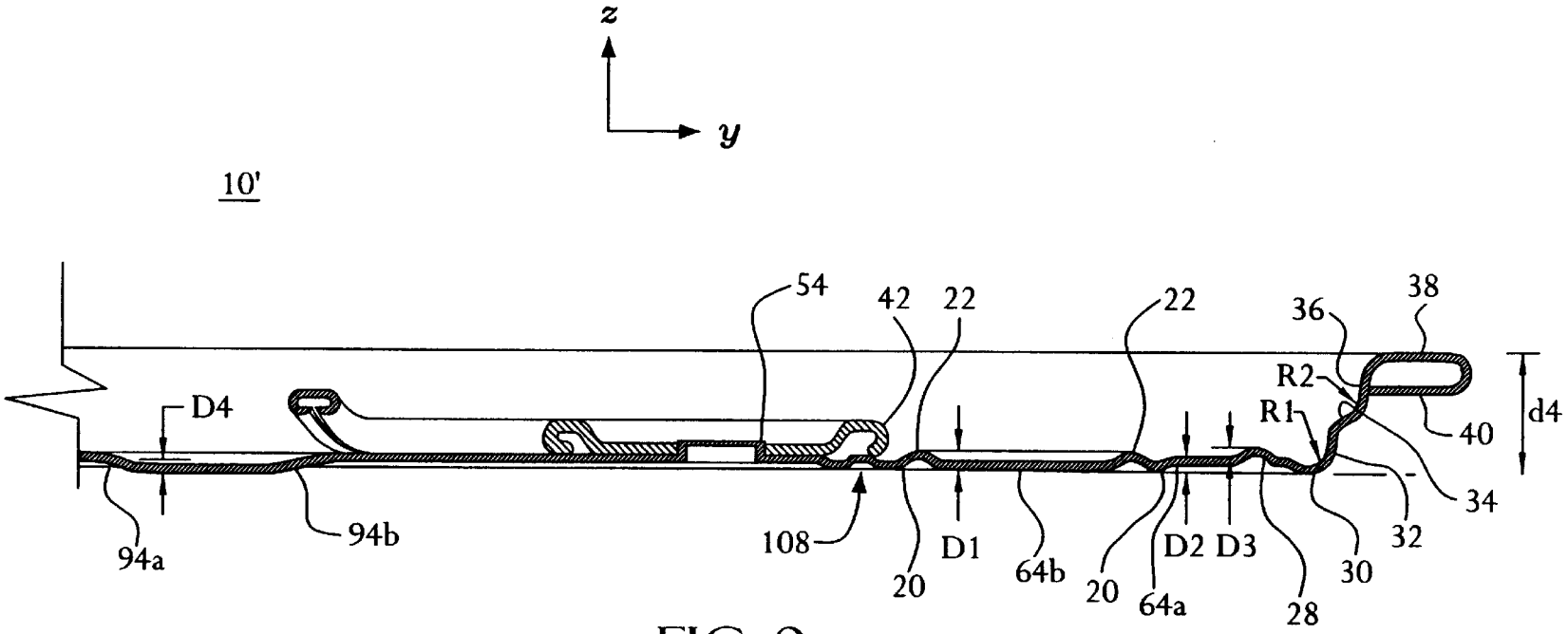
FIG. 9 is a partial cross-sectional view of a second embodiment of a can lid according to the present invention.
Figure 10:
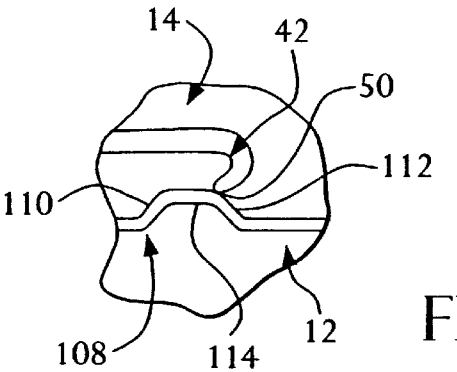
FIG. 10 is an enlarged portion of FIG. 9.

Referring particularly to FIGS. 7 and 8, second deboss defines an axis x' along a longitudinal center line of second deboss 24, and an axis y' that is perpendicular to the tangent of axis x' at any point thereon. The x' axis is oriented such that the direction from left to right is positive. The x' and y' axes will be used to describe second deboss 24.

According to another aspect of the present invention, a lower portion (that is, referring to the z axis) of second deboss 24 forms a sloped bottom 82 that yields to a shallow end 84 and an opposing deep end 86. Shallow end 84 preferably is disposed on the negative x' side of second deboss 24 relative to deep end 86, which preferably is disposed on the positive x' end. Shallow end 82 and deep end 84 refer generally to the ends of second deboss 24, and include sloped, inclined, or tapered surfaces adjacent to the ends, as well as portions of bottom 82 adjacent the ends 84 and 86. Bottom surface 82 is not inclined in the y' direction. The slope of bottom surface 82, according to a mathematical definition, is negative in the x' direction, and zero in the y' direction. Specifically, the surface of bottom 82 is flat (that is, not inclined) in the y' direction (the y' component taken along the bottom surface is zero). Preferably, bottom 82 forms an angle A (shown in FIG. 8) with top plate 12 of approximately 1 to 10 degrees, more preferably 2 to 6 degrees, and more preferably 3 to 3.5 degrees.

According to another aspect of the present invention, the contact point on contact surface 50 between tab nose 42 and top plate 12 is offset or spaced apart from a transverse center axis of second deboss 24, which preferably is in-line with centerline C. Specifically, as tab nose 42 moves downward during opening in response to a user lifting tab heel 44, tab nose 42 (at a point on the left or negative x side of tab nose 42) contacts top plate 12 at second deboss 24 on the left or negative x' side of second deboss 24. Preferably, tab 42 contacts shallow end 48.

A contact or depression force application point that is offset or spaced apart from the center lines on the left or negative x (and x') side (as defined above) has the benefit of disposing the depression point relatively close to the portion of rupture of the score 58. Further, such a depression force point is disposed relatively close to the hinge area 19 such that the location of the point at which score 58 first begins to rupture can be controlled. Employing such a force depression point enhances the degree of rupture upon opening. Specifically referring to FIG. 4, score 18 ruptures from just to the right or positive x side of head 60 to near the first bend at the upper right hand corner of score 18 upon initial pop (that is, immediately upon initial rupture).

Referring to FIGS. 1, 2, 3, and 5, back-side deboss 26 is formed in top plate 12 to the rear of rivet 16. Back-side deboss 26 is substantially symmetric around a line in the y direction that intersects rivet 16. Back-side deboss 26 is defined by a first arcuate edge 88, a second arcuate edge 90, a bottom surface 92, and sloped transitions 94*a* and 94*b*. First arcuate edge 88 is disposed on top plate 12 to the rear of second arcuate edge 90. Edges 88 and 90 each have a concave side that faces rivet 16, and are joined at smooth transitions to form an overall banana-shaped or kidney-shaped deboss. Back-side deboss bottom surface 92 is substantially flat, and substantially parallel to top plate 12. The underside of deboss bottom surface 92 is approximately 0.023" (0.58 mm) below the underside of the top surface, as identified by dimension D4 in FIG. 5.

Transitions 94*a* and 94*b* preferably comprise sloped surfaces that smoothly transition between top plate 12 and bottom surface 92. Transition 94*a* is disposed between first arcuate edge 88 and bottom surface 92, and transition 94*b* is disposed between second arcuate edge 90. Transitions 94*a* and 94*b* meet in a smooth transition near the ends of deboss 26. Preferably transition 94*a* has a more shallow incline (that is, has a lower slope) compared with transition 94*b* to enhance the ability of a user's finger to access the underside of tab heel 44.

Referring to FIGS. 1 through 5 to illustrate another aspect of the present invention, embossed ridge 28 is formed in top plate 12 outside of score 18. Embossed ridge 28 is substantially uniformly spaced apart from score 18 along most of the parabolic or horseshoe portion of score 18. Thus, the forward portion of embossed ridge 28 is parabolic or horseshoe shape.

Overall, embossed ridge 28 includes a main portion 96 and two ends 98*a* and 98*b*. Main portion 96 forms a substantially truncated oval shape that substantially surrounds score 18, except at its back end. The ovality of main portion 96 terminates at ends 98*a* and 98*b*, each of which are substantially oriented in the y direction. Ends 98*a* and 98*b*, which are preferably spaced equidistant apart from rivet 16 (that is, spaced apart in the x direction), each have an end that smoothly yields to main portion 96, and another end that terminates preferably to the rear of rivet (although laterally spaced apart from rivet 16—that is, in the x direction). Embossed ridge 28 is disposed such that its apex (referring to the z direction) is preferably approximately 0.020" (0.51 mm) apart from a topside surface of top plate 12, as shown as dimension D3 in FIG. 5.

Referring to FIG. 4, a top plate intermediate portion 102 lies between an inside of embossed ridge 28 and outer score line 58. Top plate intermediate portion 102 has a substantially uniform width, as embossed ridge 28 is preferably uniformly spaced apart from outer score line 58. An inner edge of intermediate portion 102 abuts outer score line 58 and forms an edge 104 that defines the opening after tongue 17 is ruptured from top plate 12.

To operate can lid 10, a user places his finger underneath tab heel 44 into back-side deboss 26. Placement of the user's finger is facilitated by the gradual slope of transition 94*a*. As the user lifts tab heel 44, tab nose 42 is urged downward against top plate 12. Specifically, contact surface 50 urges downward against second deboss 24. FIG. 6 shows, in phantom, tab 14 pushing against bottom surface 82. Preferably, contact surface 50 pushes against bottom surface 82 at shallow end 84 to provide the depression force application point that is offset from the center axis formed by the centerline C, as described above.

Because tab 14 is relatively rigid, tab nose 42 undergoes only a small amount of deflection or pivoting around the y axis. Such small amount of pivoting around the y axis enhances contact between tab nose 14 and second deboss 24. Because contact surface 50 urges against the incline of sloped bottom 82, a component of the depression force, has a component in the negative x and/or negative x' direction. Thus, the depression force that tab 14 exerts on tongue 17 has an overall direction that is not vertical (that is, not parallel to the z axis), as well being applied at a point that is offset from centerline C. Because the arc of second deboss 24 at upper end 84 is oriented such that the x' axis goes through or near hinge area 19, the direction of the depression force is generally downward and toward hinge area 19 and/or score 18 near head 60. The direction of the depression force enhances the opening of tongue 17.

Contact surface 50 urges against shallow end 84 until tongue 17 ruptures from top plate 12 at outer score line 58, preferably in front of rivet 16. The contact point or depression force point remains offset (as described above) even while tongue 17 is driven downward after rupture as contact surface 50 slides within second deboss 24.

As the user continues to lift tab heel 44, contact surface 50 continues to urge against second deboss 24, thereby driving tongue 17 further down (in the negative z direction) until score 18 ruptures to tail 62. Tongue 17 bends at hinge area 19. Pivoting of tab 14 is facilitated by flange 46, which deforms to enable tab 14 to bend therearound. As hinge 19 deforms to enable tongue 17 to rotate, contact surface 50 slides along second deboss 24 from shallow end 84 preferably through deep end 86.

Referring to FIGS. 9 through 12 to illustrate another embodiment of the present invention, a can lid 10' is provided that includes top plate 12, tab 14, rivet 16, tongue 17, score 18, hinge area 19, first deboss 20, primary emboss 22, back-side deboss 26, and embossed ridge 28, as well as, at its outer periphery, an outer groove 30, a lower sidewall 32, a shoulder 34, an upper sidewall 36, a ring 38, and a lip 40. Can lid 10' includes a contact emboss 108*a*.

Figure 12:
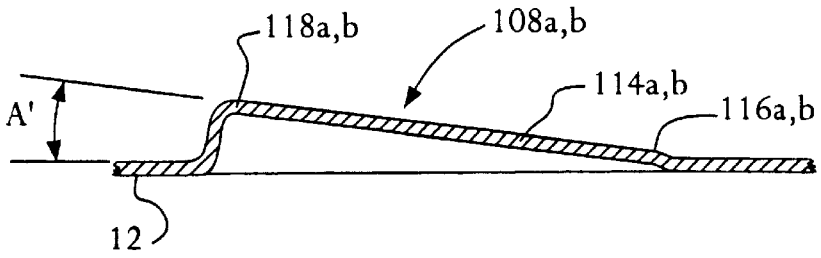
FIG. 12 is a cross-sectional view taken through FIG. 11A along lines 12—12; as well as showing a view taken through FIG. 11B along lines 12—12.
Figure 11A:
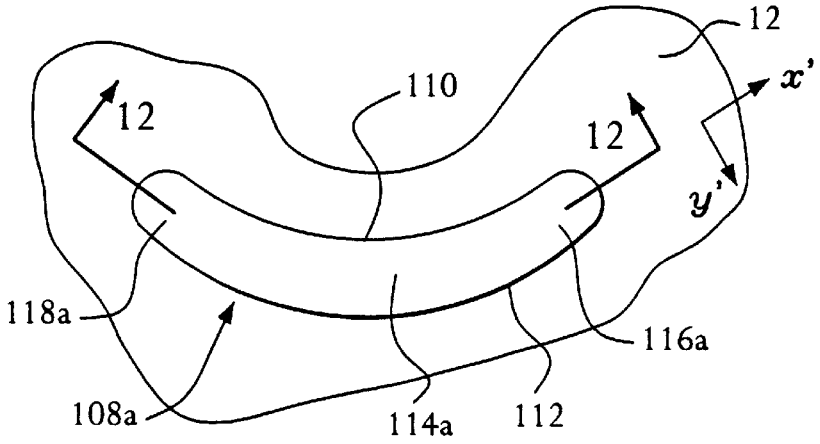
FIG. 11A is an enlarged top view of a portion of the embodiment shown in FIG. 9 showing the contact emboss.

Contact emboss 108*a* has substantially the same perimeter shape and location on top plate 12 as does second deboss 24 in the embodiment of can lid 10. As best shown in FIGS. 11A and 12, contact emboss 108*a* is raised (in the positive z direction) from top plate 12. Contact emboss 108*a* includes a first arcuate sidewall 110, a second arcuate sidewall 112, a sloped surface 114*a*, a short end 116*a*, and a tall end 118*a*. Arcuate sidewalls 110 and 112 are matching sidewalls that are preferably uniformly spaced apart and meet smoothly at opposing ends 116*a* and 118*a*. Axes x' and y' will be used to describe the contact emboss.

Tall end 118*a* is preferably formed on the negative x' side of emboss 108*a*. Tall end 118*a* and arcuate sidewalls 110 and 112 smoothly yield to sloped surface 114*a*. Arcuate sidewalls 110*a* and 112*a*, and sloped surface 114*a* smoothly yield top plate 12 at short end 116*a*. Sloped surface 114*a* is not inclined in the y' direction. The slope of sloped surface 114*a*, according to a mathematical definition, is negative in the x' direction, and zero in the y' direction. Specifically, sloped surface 114*a* is flat (that is, not inclined) in the y' direction (the y' component taken along, the sloped surface 114*a* is zero). Preferably, sloped surface 114*a* forms and angle A' with top plate 12, as shown in FIG. 12.

Figure 11B:
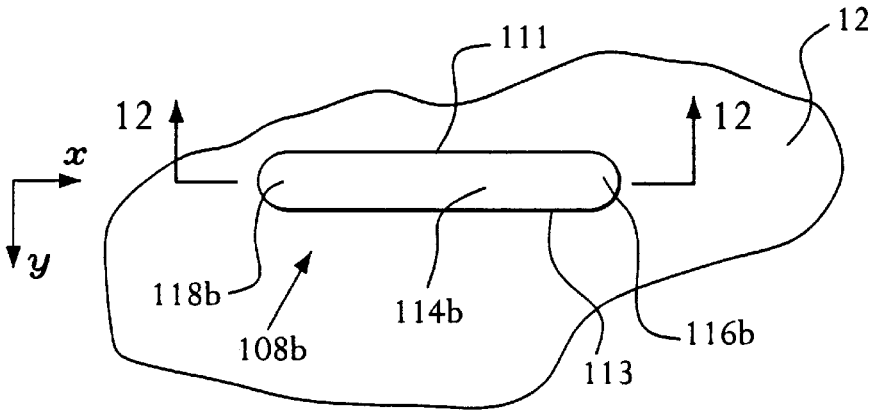
FIG. 11B is an enlarged top view of a portion of another embodiment of a contact emboss according to the present invention.

Referring to FIG. 11B and FIG. 12 to illustrate another embodiment of the present invention, a contact emboss 108*b* includes a first sidewall 111, a second sidewall 113, a sloped surface 114*b*, a short end 116*b*, and a tall end 118*b*. Contact emboss 108*b* is raised (in the positive z direction ) from top plate 12. Sidewalls 111 and 113 are matching straight or rectilinear sidewalls that are preferably uniformly spaced apart and meet smoothly at opposing ends.

Tall end 118*b* is preferably formed on the negative x side. Tall end 118*b* and sidewalls 111 and 113 smoothly yield to sloped surface 114*b*. Sidewalls 111 and 113, and sloped surface 114*b*, smoothly yield to top plate 12 at short end 116*b*. Sloped surface 114*b* is not inclined in the y direction. The slope of sloped surface 114*b*, according to a mathematical definition, is negative in the x direction, and zero in the y direction. Specifically, sloped surface 114*b* is flat (that is, not inclined) in the y direction (the y component taking along the sloped surface 114*b* is zero). Preferably, sloped surface 114*b* forms and angle A' with top plate 12, as shown in FIG. 12.

The operation of can lid 10' having arcuate emboss 108*a* is similar to that described with respect to can lid 10, and, therefore, the description of operation of can lid 10 applies to the operation of can lid 10', with the a few clarifications. Contact surface 50 urges against tall end 118*a*, offset from centerline C, as described above. Because of the incline of surface 114*a*, the depression force has a component in the negative x' direction, as explained above. Tab nose 14 slides down contact emboss 108*a* from tall end 118*a* to short end 116*a* as hinge 19 deforms.

The operation of can lid 10' having rectilinear emboss 108*b* is similar to that described with respect to can lid 10, as well as with respect to can lid 10' having arcuate emboss 108*a*. Therefore, those operating discussions apply to the embodiment containing rectilinear emboss 108*b*, with a few clarifications. Contact surface 50 urges against tall end 118*b*, offset from centerline C, as described above. Because of the incline of surface 114*b*, the depression force has a component in the negative x direction, as explained above. Because rectilinear emboss 108*b* lacks arcuate surfaces to mate to arcuate tab nose 14, contact surface 50 preferably slides down a forward portion of emboss 108*b*. Tab 14 may, thus, may deform forward as is pivots downward. Alternatively, contact surface 50 may slide from a forward portion of tall end 118*b* to a relatively rear portion of short end 116*b*.

Figure 13:
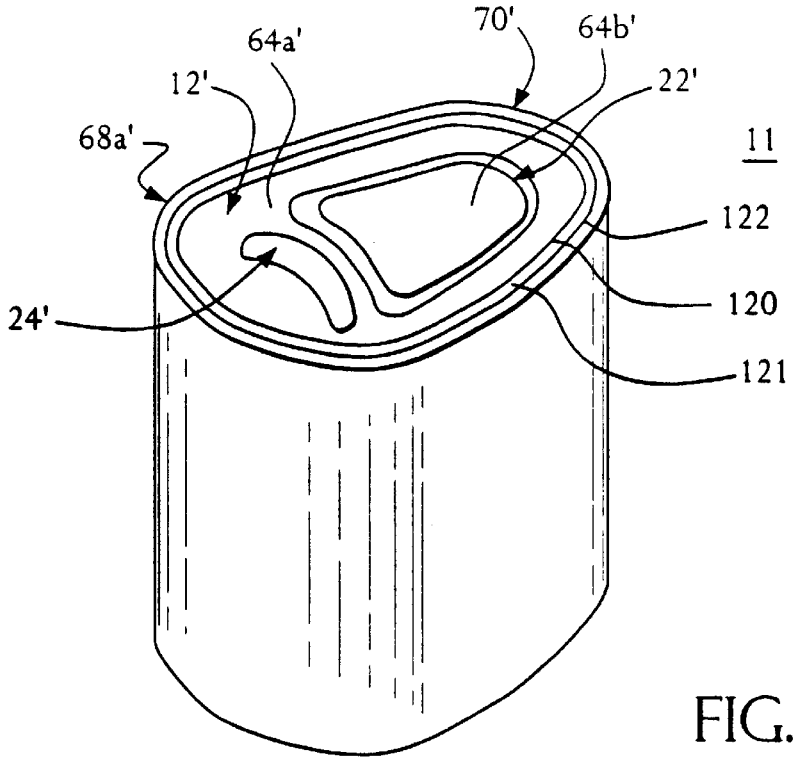
FIG. 13 is a perspective view of a die according to another aspect of the present invention.
Figure 14:
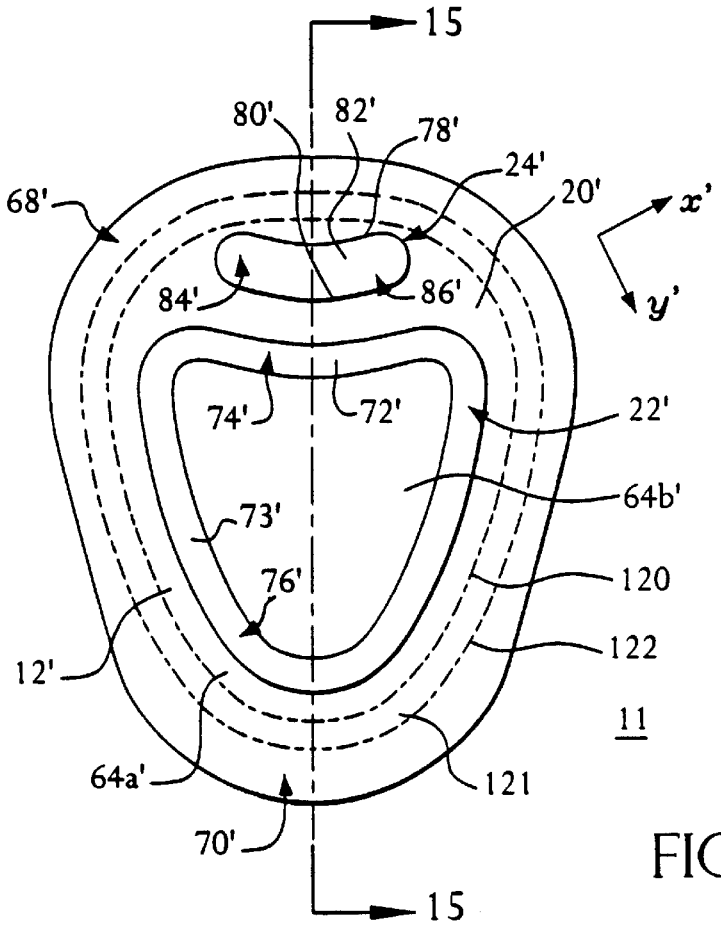
FIG. 14 is a top view of the die shown in FIG. 13.
Figure 15:
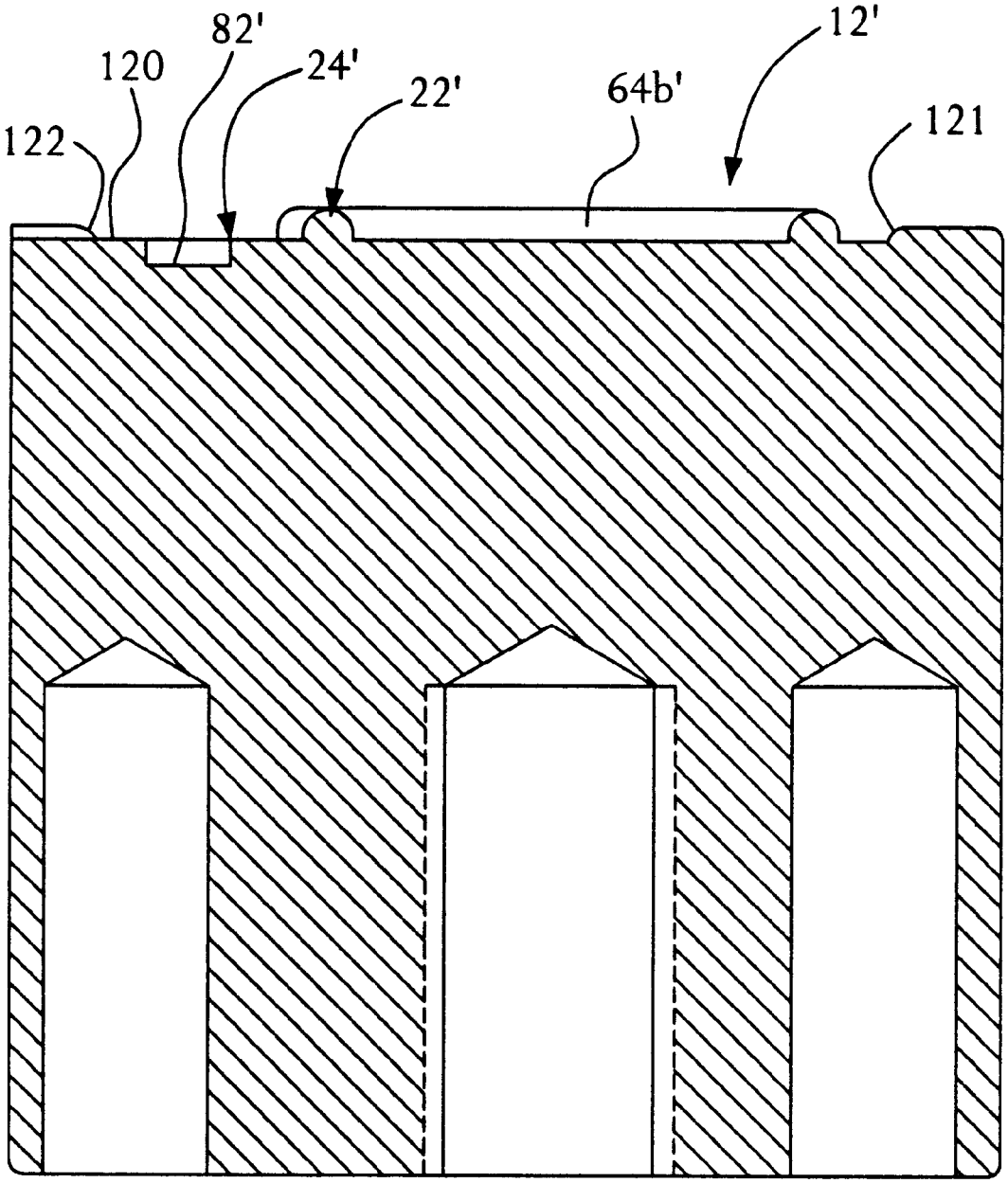
FIG. 15 is a cross-sectional view of the die shown in FIG. 14 taken along lines 15—15.

Referring to FIGS. 13 through 15 to illustrate another aspect of the present invention, a die insert 11 is provided that has a top surface 12' that includes a first deboss 20', emboss 22', and second emboss 24'. First deboss 20' has a wide end 68' on its back end and a narrow end 70' on its forward end to form an ovate shape. First deboss 20' includes lower portions (that is, referring to the z direction) 64*a*' and 64*b*'. An inclined transition 121 that corresponds to the boundaries of first deboss 20' is disposed at its perimeter. Transition 121 is defined by outer boundary 122 and inner boundary 120, which are shown in dashed lines in FIG. 14 to illustrate their curved nature. Surfaces 64*a*' and 64*b*' within inner boundary 120 are substantially flat. Lower portion 64*a* is narrow (that is, in the plane defined by the x and y axes) in the lower narrow end 70' , because lower portion 64*a*' is bounded by transition 121 and emboss 22'.

Emboss 22' is a substantially heart shaped emboss disposed entirely within first deboss 20'. Emboss 22' has an arcuate portion 72' disposed at its back end that smoothly yields to a parabolic or horseshoe portion 73'. Arcuate portion 72' forms an emboss wide end 74' at a back end of emboss 22' and a parabolic or horseshoe portion 73' that forms a narrow end 76' at a forward end of emboss 22'. Portion 73' of emboss 22' substantially follows, and is uniformly spaced from, the parabolic or horseshoe portion of first deboss 20'. Lower portion 64*b*' of first deboss 20' lies within emboss 22'. An underside of lower portion 64*b*' is substantially at the same level as the base line defined by the underside surface of groove 30'. The peak of the upper side of emboss 22' defines a dimension from surface 64*b*' that is preferably approximately 0.023" (0.58 mm).

Second deboss 24' is formed entirely within first deboss 20' in back of emboss 22'. The perimeter of deboss 24' is asymmetric around a y axis center line. The perimeter of second deboss 24' is formed by first arcuate side 78' and a matching second arcuate side 80' that is spaced apart from first arcuate side 78'. Arcuate side 78' and 80' meet at opposing ends.

A lower portion (that is, referring to the z axis) of second deboss 24' forms a sloped bottom 82' that yields to a shallow end 84' and an opposing deep end 86'. Shallow end 84' and deep end 86' are oriented as shown in FIG. 14. Shallow end 84' and deep end 86' refer generally to the ends of second deboss 24', and include sloped inclined, or tapered surfaces adjacent to the ends, as well as portions of bottom 82' adjacent the ends 84' and 86'. Bottom surface 82' is not inclined in the direction relative to the y direction (as defined with reference to FIG. 7, and shown in FIG. 14). The slope of bottom surface 82', according to a mathematical definition, is negative in the x' direction (as defined with reference to FIG. 7), and zero in the y' direction. Specifically, the surface of bottom 82' is flat (that is, not inclined) in the y' direction (the y' component taking along the bottom surface is zero).

Figure 16:
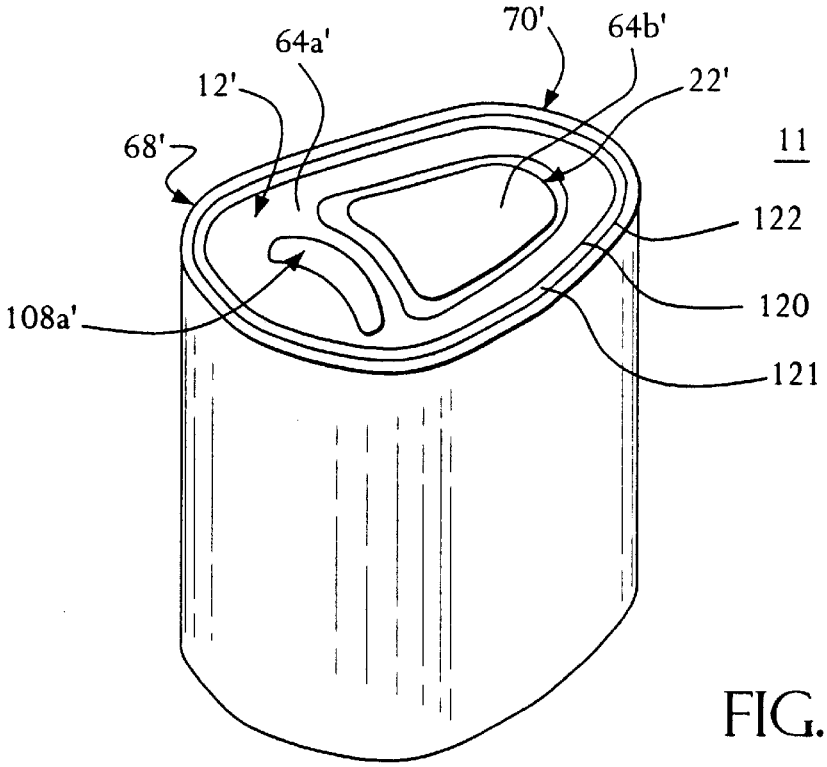
FIG. 16 is a perspective view of a die according to another aspect of the present invention.
Figure 17:
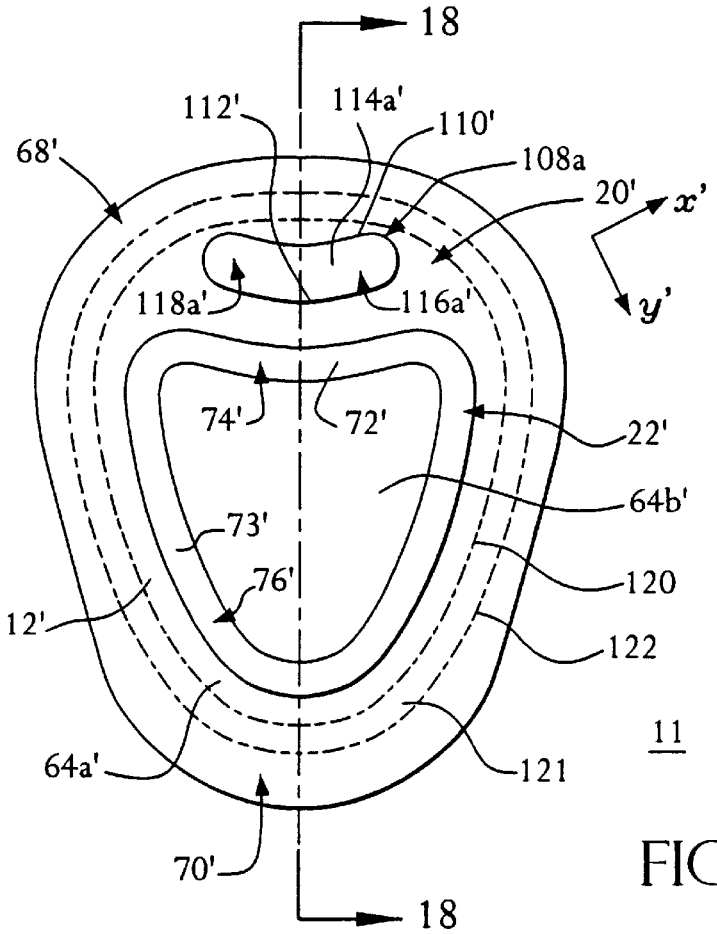
FIG. 17 is a top view of the die shown in FIG. 16.
Figure 18:
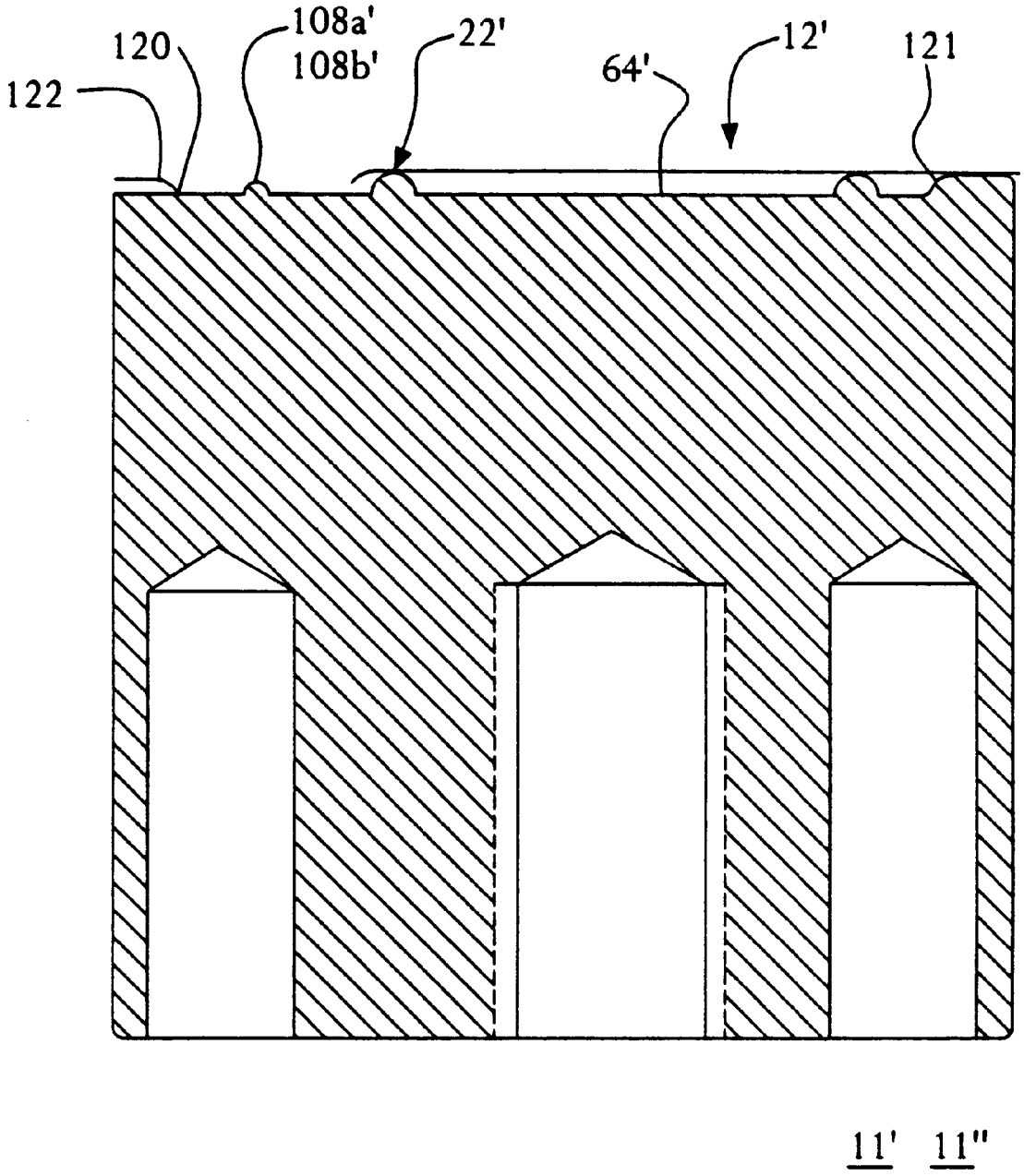
FIG. 18 is a cross sectional view of the die shown in FIG. 17 taken along lines 17—17.

Referring to FIGS. 16 through 18 to illustrate another embodiment of the present invention, a die insert 11' is similar to die insert 11, and, thus, the description relating to die insert 11 applies to die insert 11' with a few clarifications. Die insert 11' lacks second deboss 24' and includes a contact emboss 108*a*'. Thus, die insert 11' includes top surface 12', first deboss 20' (including transitions 120, 121, and 122), emboss 22', and contact emboss 108*a*'. Contact emboss 108*a*' has substantially the same perimeter or outline shape and location on top plate 12' as does second deboss 24' in the embodiment of die insert 11'. Contact emboss 108*a*' is raised (in the positive z direction) from top plate 12'. Contact emboss 108*a*' includes a first arcuate sidewall 110', a second arcuate sidewall 112', a sloped surface 114*a*', a short end 116*a*', and a tall end 118*a*', which are correspond to like components shown in FIGS. 9, 10, 11*a* and 12. Arcuate sidewalls 110' and 112' are matching sidewalls that are preferably uniformly spaced apart and meet smoothly at opposing ends. Thus, die insert 11' may be employed to form can lid 10' having arcuate emboss 108*a*.

According to another embodiment of the present invention, which will be also described with reference to FIG. 18, another die insert 11" is similar to die inserts 11 and 11', except that die insert 11" according to this embodiment lacks second deboss 24' and contact emboss 108*a*', and includes a contact emboss 108*b*'. Thus, the description relating to die insert 11 and die insert 11' having contact emboss 108*a*' applies to die insert 11" having contact emboss 108*b*', with a few clarifications. Die insert 11' includes top surface 12', first deboss 20' (including transitions 120, 121, and 122), emboss 22', and contact emboss 108*b*'. Contact emboss 108*b*' is raised (in the positive z direction ) from top plate 12'. Contact emboss 108*b*' may include a first sidewall 111', a second sidewall 113', a sloped surface 114*b*', a short end 116*b*', and a tall end 118*b*', which are not shown in FIG. 16, but are analogous to the corresponding components shown in FIG. 11B. A top view and perspective view are omitted as cumulative except for contact emboss 108*b* of FIG. 11B replacing contact emboss 108*a* of FIG. 11A. Rectilinear sidewalls 111' and 113' are matching sidewalls that are preferably uniformly spaced apart and meet smoothly at opposing ends. Thus, die insert 11' may be employed to form can lid 10' having arcuate emboss 108*b*.

The following description of die insert 11' applies to embodiments of the present invention having emboss 108*a*' and/or 108*b*' (the latter, which is embodiment 11", is referred to in parentheses for clarity). Tall end 118*a*' (118*b*') is preferably formed on the negative x' (negative x) side. Tall end 118*a*' (118*b*') and arcuate sidewalls 110' and 112' (rectilinear sidewalls 111' and 113') smoothly yield to sloped surface 114*a*' (114*b*'). Arcuate sidewalls 110' and 112' rectilinear sidewalls 111' and 113'), and sloped surface 114*a*' (114*b*') smoothly yield top surface 12' at short end 116*a*' (116*b*'). Sloped surface 114' (114*b*') is not inclined in the y' (y) direction as defined in FIG. 11A (FIG. 11B). The slope of sloped surface 114*a*' (114*b*'), according to a mathematical definition, is negative in the x' (x) direction, and zero in the y' (y) direction. Specifically, sloped surface 114*a*' (114*b*') is flat (that is, not inclined) in the y' (y) direction (the y' component taking along the sloped surface 114*a*' (114*b*') is zero).

Die inserts 11 and 11' may be employed with conventional die equipment, including mating die surfaces, as will be understood by those familiar with such operations and processes. Die insert 11 may be employed to form first deboss 20, emboss 22, and second emboss 24, and may be sized to fit within score 18. Die insert 11' may be employed to form first deboss 20, emboss 22, and contact emboss 108*a* (and/or contact emboss 108*b*) and maybe sized to fit within score 18, as will be apparent to persons familiar with die forming operations and principles. As will be understood by persons familiar with metal working and/or can forming technology, die inserts 11 and 11' each have a cooperating punch (not shown) that matches the inserts. Specifically, the punches have a shape that is the reverse of the corresponding die insert such that the embossed structures on the insert fits into corresponding debossed structures on the punch, and the debossed structures on the insert fits into corresponding embossed structures on the punch.

Modifications may be made to the embodiments described above without departing from the broad inventive concepts thereof. Accordingly, the present invention is not limited to the particular embodiments nor to the theoretical description disclosed, but is intended to cover all modifications that are within the spirit and scope of the invention as defined by the appended claims.

What is claimed is:

1. A can lid comprising:

a top plate; a tab, coupled to the top plate by a rivet, having a nose and an opposing heel a score, formed in the top plate, having a first end and a second end that define a hinge portion therebetween;

a tongue, defined by the score and coupled to the hinge portion;

a first deboss formed entirely in the tongue;

an emboss formed in the tongue; and a second deboss, formed in the tongue between the rivet and the emboss, having a first arcuate side and an opposing second arcuate side, the second deboss capable of receiving force applied by the tab nose, the emboss and the second deboss being formed within the first deboss.

2. The can lid of claim 1 wherein the second deboss has a bottom surface of varying depth.

3. The can lid of claim 1 wherein the second deboss has a sloped bottom surface that has a shallow end and opposing deep end.

4. The can lid of claim 1 wherein the emboss comprises a heart-shaped emboss.

5. The can lid of claim 1 further comprising an embossed ridge, disposed on the lid outside of the tongue, most of the embossed ridge spaced equidstant from the score.

6. The can lid of claim 1 further comprising a back-side deboss formed in the top plate beneath the tab heel, whereby a user's finger is insertable into a gap between the tab heel and the back-side boss.

7. The can lid of claim 6 wherein the emboss substantially follows the score.

8. The can lid of claim 1 wherein the second deboss has an arcute surface disposed substantially below the nose.

9. The can lid of claim 1 wherein the first arcuate side includes a first end of the second deboss and the second arcuate side includes a second end of the second deboss to form a pair of second deboss ends, each are of the two arcuate sides adjacent the second deboss ends.

10. The can lid of claim 9 further comprising an inclined bottom surface formed by the two arcuate sides and the two ends.

11. The can lid of claim 10 wherein the bottom surface has a varying depth.

12. The can lid of claim 10 wherein the bottom member has a first shallow portion and a second deep portion such that the nose contacts the shallow portion before contacting the deep portion to apply a force in a direction that benefits the score opening characteristics.

13. A can lid comprising:

a top plate;

a tab, coupled to the top plate, having a nose;

a score, formed in the top plate, having a first end and a second end that define a hinge portion therebetween;

a tongue, defined by the score and integrally formed with the hinge portion;

a first deboss formed entirely in the tongue;

an emboss formed in the tongue;

a contact emboss, formed in the tongue substantially below the nose, having an arcuate side and two opposing ends adjacent the arcuate side, each one of the emboss and the contact emboss are formed within the first deboss.

14. The can lid of claim 13 wherein the contact emboss comprises two opposing arcuate sides, each one of the two arcuate sides adjacent the two ends.

15. The can lid of claim 13 wherein the contact emboss has a varying height.

16. The can lid of claim 13 wherein the contact emboss comprises a first short portion and a second tall portion such that the nose contacts the tall portion before contacting the short portion to apply a force that benefits the score opening characteristic.

17. A can lid comprising:

a top plate;

a tab, coupled to the top plate, having a nose;

a score, formed in the top plate, having a first end and a second end that define a hinge portion therebetween;

a tongue, defined by the score and integrally formed with the hinge portion;

a first deboss formed entirely in the tongue;

a primary emboss formed in the tongue;

a contact emboss, formed in the tongue substantially below the nose, having a substantially rectilinear side and two opposing ends adjacent the rectilinear side, each one of the primary emboss and the contact emboss being formed within the first deboss.

18. The can lid of claim 17 wherein the contact emboss comprises two opposing rectilinear sides, each one of the two rectilinear sides adjacent the two ends.

19. The can lid of claim 17 wherein the contact emboss has a varying height.

20. The can lid of claim 17 wherein the contact emboss comprises a first short portion and a second tall portion such that the nose contacts the tall portion before contacting the short portion to apply a force that benefits the score opening characteristic.

* * * * *